US008967619B2

(12) United States Patent
Takahata et al.

(10) Patent No.: US 8,967,619 B2
(45) Date of Patent: Mar. 3, 2015

(54) IMAGE READING APPARATUS

(71) Applicants: Muneaki Takahata, Toyoake (JP); Tianjin Xie, Nagoya (JP)

(72) Inventors: Muneaki Takahata, Toyoake (JP); Tianjin Xie, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/081,283

(22) Filed: Nov. 15, 2013

(65) Prior Publication Data

US 2014/0138902 A1 May 22, 2014

(30) Foreign Application Priority Data

Nov. 16, 2012 (JP) ..... 2012-251880

(51) Int. Cl.
*B65H 5/02* (2006.01)
*B65H 3/06* (2006.01)

(52) U.S. Cl.
CPC ..... *B65H 3/06* (2013.01)
USPC ..... 271/272

(58) Field of Classification Search
CPC .... B65H 5/062; B65H 29/12; B65H 2601/11; B65H 27/00; B65H 2511/22; B65H 29/22; B65H 2404/1114; B21B 27/05; F16C 13/028; D21G 1/022
USPC ..... 271/272–274, 314; 492/2, 7
See application file for complete search history.

(56) References Cited

U.S. PATENT DOCUMENTS 3,678,846 A * 7/1972 Bjorkegren ..... 100/155 R
5,606,357 A * 2/1997 Bekki ..... 347/104

FOREIGN PATENT DOCUMENTS

| | | | |
|---|---|---|---|
| JP | 61-124467 A | | 6/1986 |
| JP | 61-188344 | * | 8/1986 |
| JP | 61-269140 A | | 11/1986 |
| JP | 62-047565 | | 3/1987 |
| JP | H02-291352 A | | 12/1990 |
| JP | H08-133553 A | | 5/1996 |
| JP | 11-127301 A | | 5/1999 |
| JP | 2000-026003 A | | 1/2000 |
| JP | 2000-165594 A | | 6/2000 |
| JP | 2001-019255 A | | 1/2001 |
| JP | 2002-012354 A | | 1/2002 |

* cited by examiner

*Primary Examiner* — Thomas Morrison
(74) *Attorney, Agent, or Firm* — Banner & Witcoff, Ltd.

(57) ABSTRACT

An image reading apparatus has a separation section configured to supply a sheet one by one, at least three driving rollers arranged downstream of the separation section in a sheet conveying direction and configured to convey the sheet, at least three driven rollers configured to be urged by the driving rollers and driven to rotate by rotation of the driving rollers, respectively, and an image reader unit configured to read an image of the sheet conveyed in the conveying direction. Sheet conveying forces by one of at least three driven rollers and one of at least three driving rollers arranged at the central portions in the sheet width direction is greater than sheet conveying forces by others of the at least three driven rollers and others of the at least three driving rollers arranged at both side portions in the sheet width direction.

4 Claims, 9 Drawing Sheets

IMAGE READING APPARATUS

Cross-Reference to Related Application

This application claims priority under 35 U.S.C. §119 from Japanese Patent Applications No. 2012-251880 filed on Nov. 16, 2012. The entire subject matter of the application is incorporated herein by reference.

BACKGROUND

Technical Field

An aspect of the present invention relates to an image reading apparatus.

Related Art

A sheet conveying device is provided, for example, to an image reading apparatus. Typically, in the image reading apparatus, a sheet is picked up from an original sheet placing tray and conveyed along a sheet convey path in a predetermined conveying direction. The sheet convey path is passing an image reading section. When the sheet passes through the image reading section, an image formed on the sheet is read by an image reading unit.

Generally, the sheet conveying device has a roller unit for conveying the sheet on an upstream side, in the sheet conveying direction, with respect to the image reading section. Such a roller unit typically has three rollers, which are arranged to be rotatable about a rotation axis extending in a sheet-width direction, which is perpendicular to the sheet convey direction. The three rollers are arranged in the sheet-width direction in a spaced manner. When a sheet of which the width extends over the three rollers (hereinafter, such a sheet will be referred to as a normal size sheet) is conveyed, the normal sheet contacts circumferential surfaces of the three rollers. Thus, the normal size sheet receives a conveying force from the three rollers.

If a sheet of which width is smaller than a distance between two rollers respectively arranged at both sides, among the three rollers (hereinafter, such a sheet will also be referred to as a small size sheet) is conveyed such that the center of the sheet in its width direction is aligned to the center of the conveyance path, the small size sheet only contacts a circumferential surface of one roller arranged at a central portion. Therefore, a conveying force applied by the central roller to the small size sheet is less than the conveying force the normal size sheet receives from three rollers. As a result, when the small size sheet is conveyed, in comparison with a case where the normal size sheet is conveyed, a speed of the sheet when passing through the image reading section might be lowered. In such a case, an image of the small size sheet read by the image reader unit may be expanded in the sheet conveying direction.

According to aspects of the invention, there is provided an image reading apparatus, which has a separation section configured to supply a sheet one by one, at least three driving rollers arranged on a downstream, in a sheet conveying direction, of the separation section and configured to convey the sheet, at least three driven rollers configured to be urged by the driving rollers and driven to rotate by rotation of the driving rollers, respectively, and an image reader unit configured to read an image of the sheet conveyed in the conveying direction. The at least three driven rollers are arranged at a central portion and both side portions in a sheet width direction, and sheet conveying forces by one of the at least three driven rollers and one of the at least three driving rollers arranged at the central portions in the sheet width direction is greater than sheet conveying forces by others of the at least three driven rollers and others of the at least three driving rollers arranged at both side portions in the sheet width direction.

According to aspects of the invention, it is possible to suppress a situation that the conveying force applied to the small size sheet becomes insufficient. As a result, even the small size sheet can be conveyed at an appropriate conveying speed.

BRIEF DESCRIPTION OF THE ACCOMPANYING DRAWINGS

DETAILED DESCRIPTION OF EMBODIMENT

Figure 1:
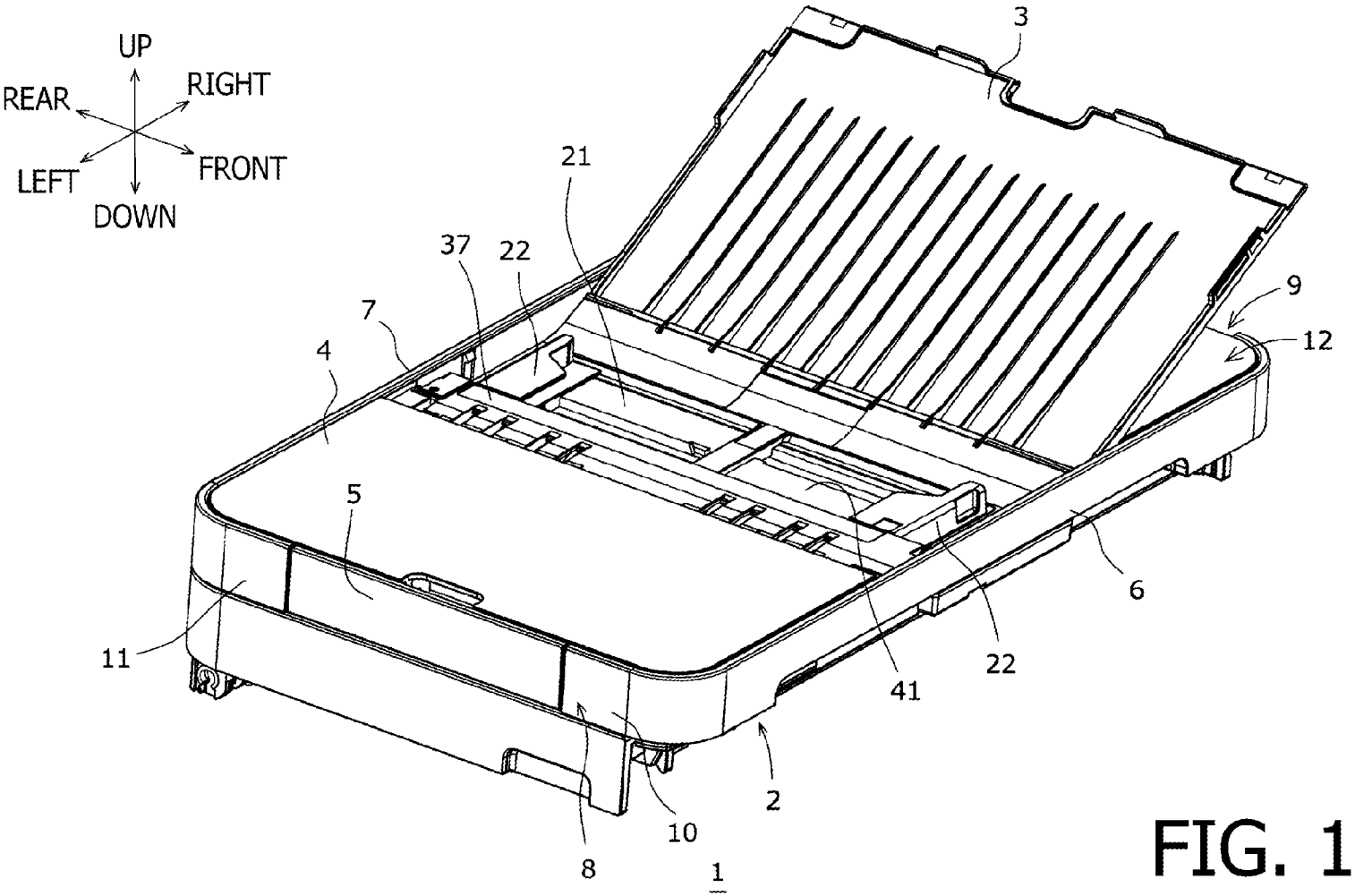
FIG. 1 is a perspective view of an image reading apparatus according to an embodiment of the invention, viewed from an upper-left front side thereof, and a tray is located at a tray position.

Hereinafter, an embodiment of the invention will be described referring to the accompanying drawings.

<Outer Configuration>

An image reading apparatus 1 according to an embodiment of the invention has a housing 2, a tray 3, a maintenance cover 4 and an outlet cover 5. The tray 3, the maintenance cover 4 and the outlet cover 5 are attached to the housing 2. The housing 2 includes a front side plate 6, a rear side plate 7, a left side plate 8 and a right side plate 9.

Figure 2:
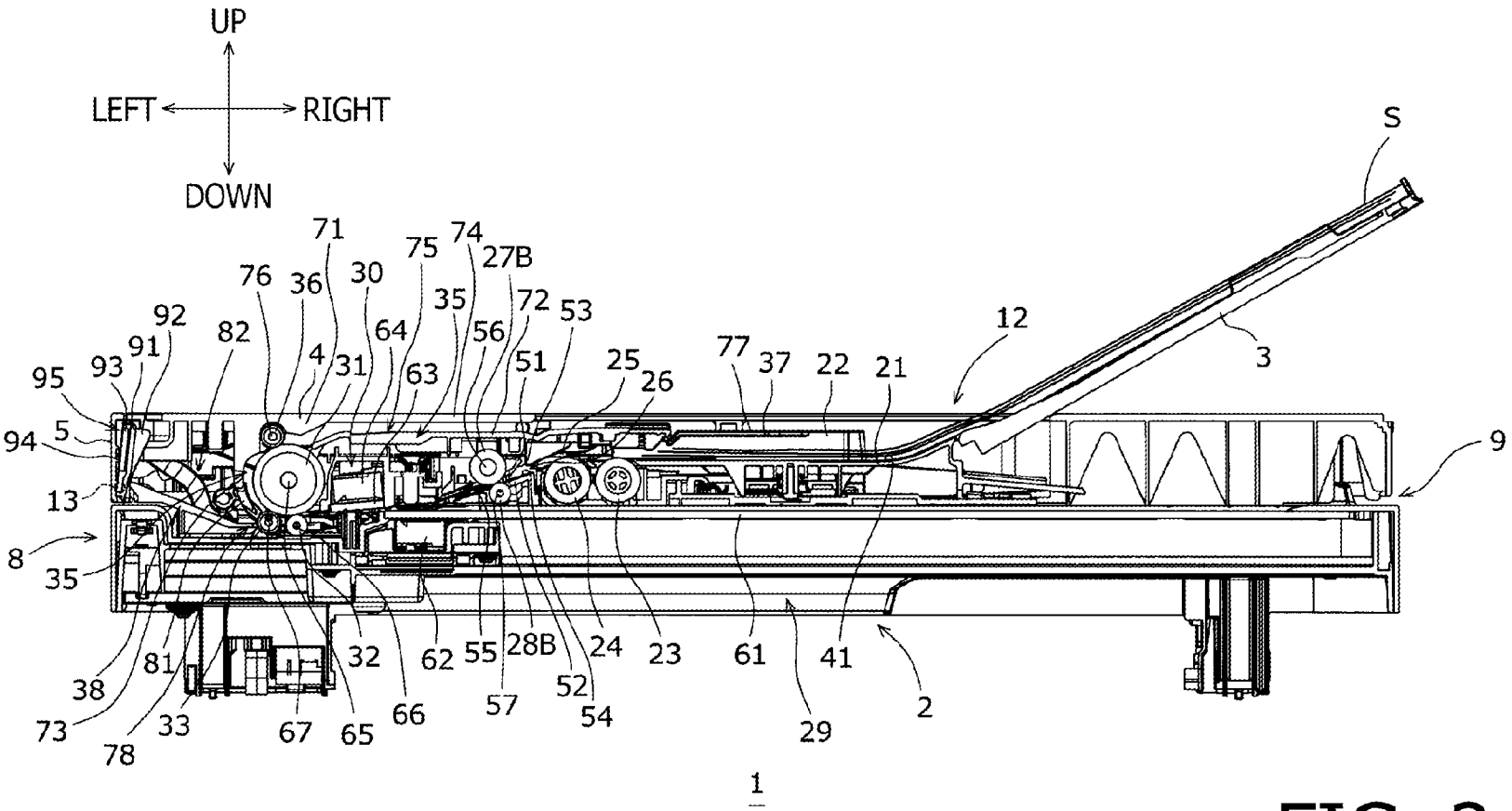
FIG. 2 is a cross-sectional side view of the image reading apparatus depicted in FIG. 1.
Figure 3:
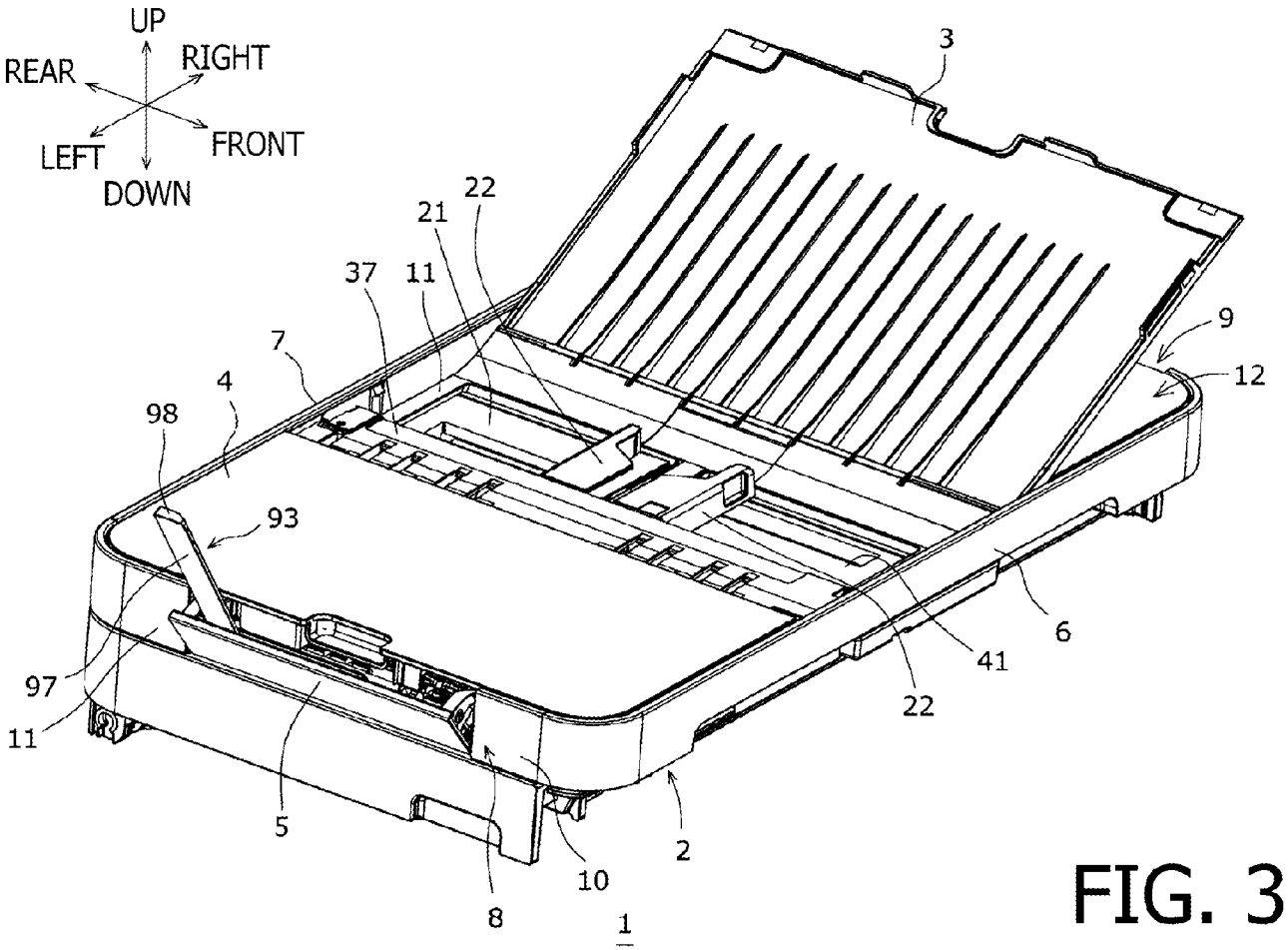
FIG. 3 is a perspective view of the image reading apparatus according to the embodiment of the invention, viewed from an upper-left front side thereof, and a outlet cover is located at the tray position.

As depicted in FIGS. 1-3, orientations of the image reading apparatus 1 will be referred to such that a side where the tray 3 and the maintenance cover 4 are arranged is an upside, a side where the outlet cover 5 is provided is a left side, and a side where the front side plate 6 is provided is a front side. With this definition, an up-and-down direction, a right/left direction and a front/rear direction of the image reading apparatus 1 are defined. In each drawing, directions thus defined are indicated in association with arrows.

According to the embodiment, another housing of a printer (not shown) is connected to the housing 2 of the image reading apparatus 1 from the above. As described above, the housing 2 has the front side plate 6, the rear side plate 7, the left side plate 8 and the right side plate 9. The front and the rear side plates 6 and 7 are arranged along the front-and-rear direction with a space therebetween. The left side plate 8 is arranged between left ends of the front side plate 6 and the rear side plate 7. The left side plate 8 is divided into a front-left side plate 10 and a rear-left side plate 11. The front-left side plate 10 and the rear-left side plate 11 are arranged to be spaced in the front-and-rear direction. The right side plate 9 is arranged between right ends of the front side plate 6 and the rear side plate 7.

The tray 3 is arranged between central portions of the front side plate 6 and the rear side plate 7. The tray 3 is configured to be rotatable about a rotation axis which extends in the front-and-rear direction along a right-side end of the tray 3 itself, between a cover position and a tray position. The cover position of the tray 3 is defined as a position at which an upper surface of the tray 3 is substantially in parallel with the maintenance cover 4 and/or an upper surface 12 to form a substantially same plane therewith, and covers an outlet section 37. The tray position of the tray 3 is defined as a position where a right side of the tray 3 is lifted as depicted in FIG. 1 so that an original sheet can be placed on the tray 3.

The maintenance cover 4 is arranged between the front side plate 6 and the rear side plate 7. The maintenance cover 4 is arranged to be rotatable about a rotation axis which extends in the front-and-rear direction along a right side of the maintenance cover 4 between a closed position and an opened position. The closed position of the maintenance cover 4 is defined as a position where the maintenance cover is substantially in the same plane with the upper surface of the tray 3 located at the cover position and the upper surface 12, and the maintenance cover 4 covers a first LF roller 27, a second LF roller 31 and an upper reader unit 30. The opened position of the maintenance cover 4 is defined as a position where the left side of the maintenance cover 4 is lifted with respect to the housing 2 so that a jammed original sheet inside the image reading apparatus 1 can be removed.

The outlet cover 5 is arranged, on the left side surface of the housing 2, between the front-left side plate 10 and the rear-left side plate 11. The outlet cover 5 is arranged to be rotatable about a rotation axis 13 which extends in the front-and-rear direction along a lower end of the outlet cover 5 between a cover position and a tray position. The cover position of the outlet cover 5 is defined as a position where the outlet cover 5 is oriented upright along the up-and-down direction, i.e., in the vertical direction, as depicted in FIGS. 1 and 2. When the outlet cover 5 is located at the cover position, an outer surface of the outlet cover 5 extends substantially in the same plane including outer surfaces of the front-left side plate 10 and the rear-left side plate 11. The tray position of the outlet cover 5 is defined as a position where a left side of the outlet cover 5 is lifted as depicted in FIGS. 3 and 4.

<Inner Configuration>

Figure 4:
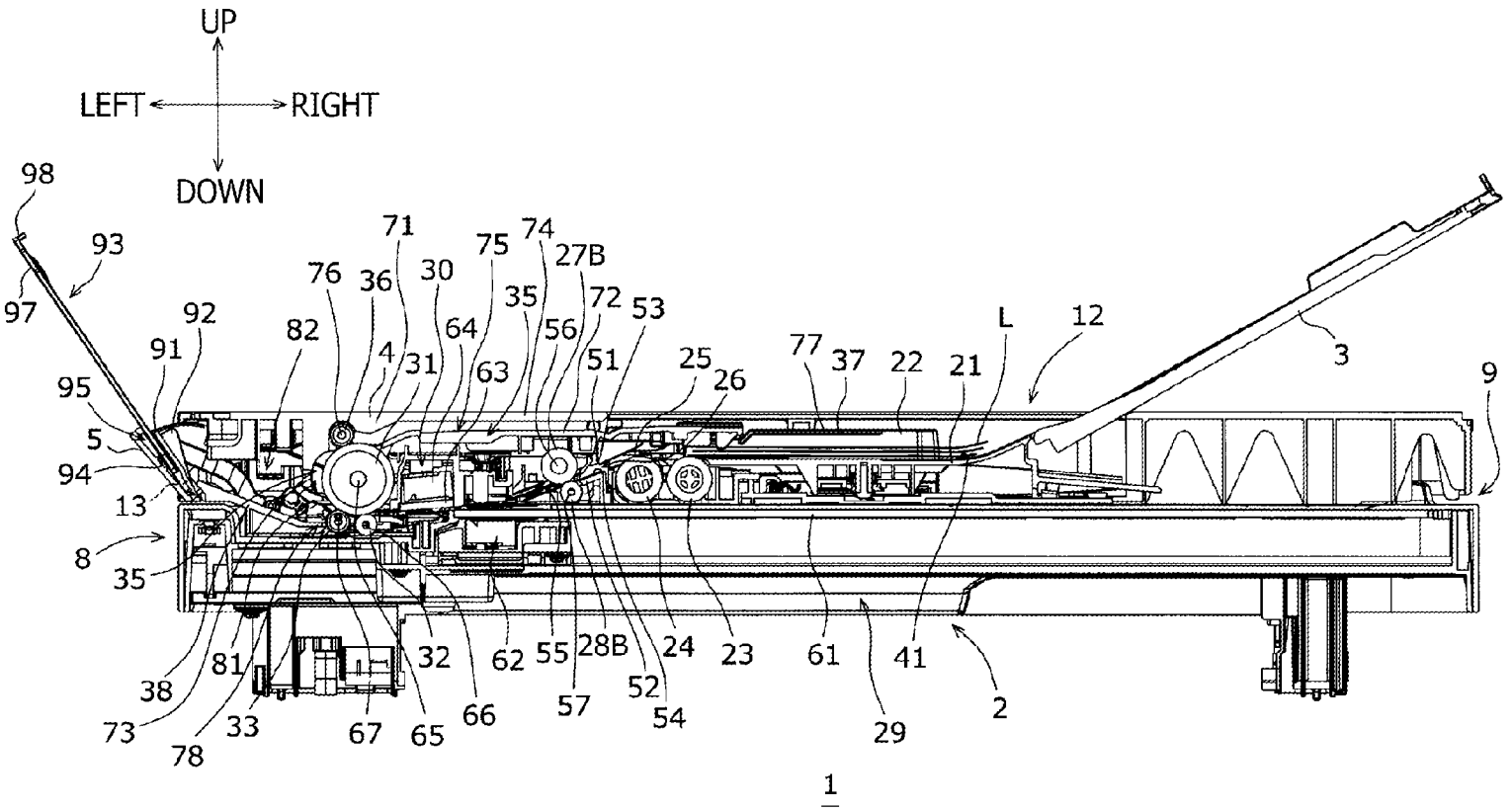
FIG. 4 is a cross-sectional side view of the image reading apparatus depicted in FIG. 3.
Figure 5:
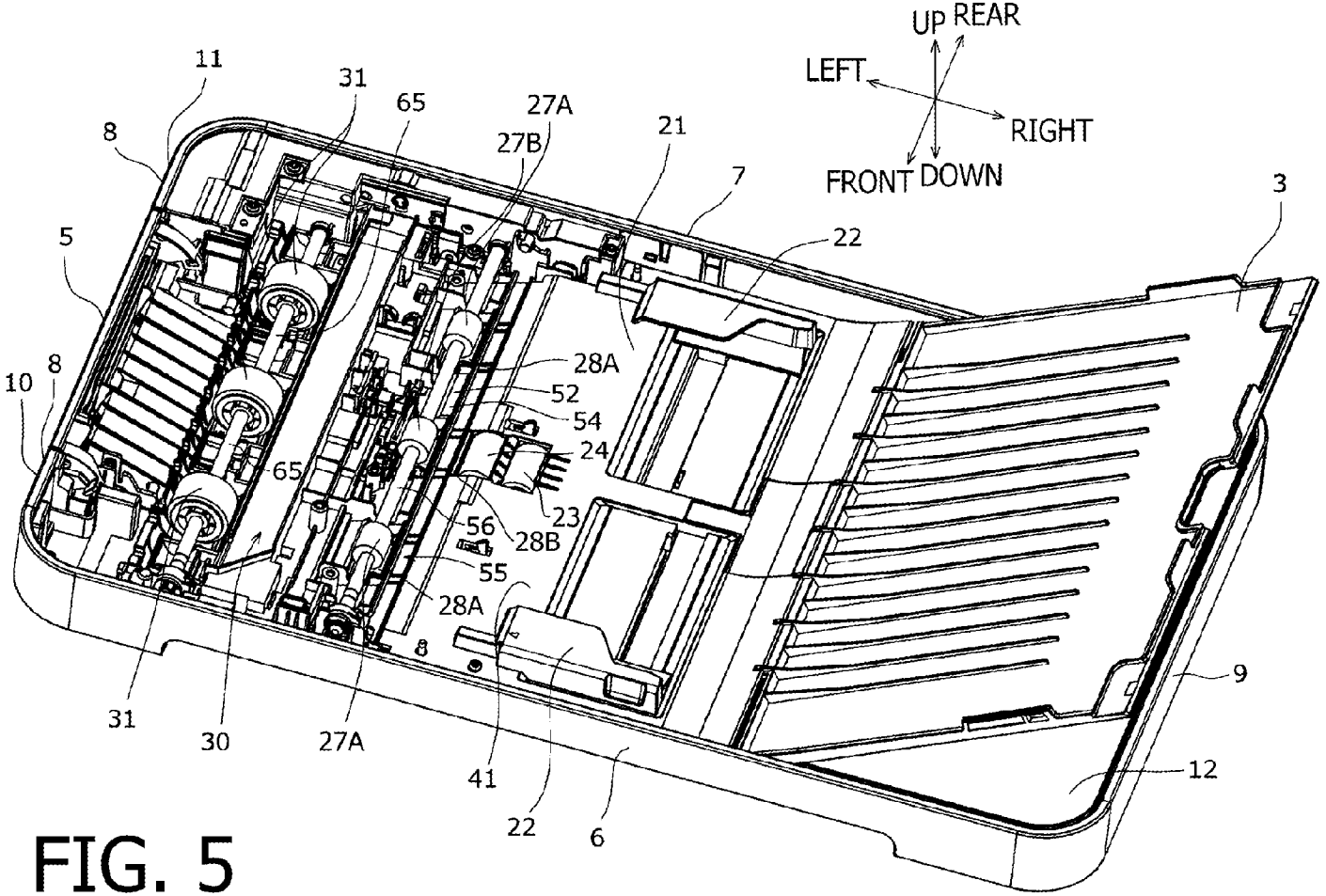
FIG. 5 is a perspective view of the image reading apparatus viewed from an upper-right front direction thereof, when the tray is located at the tray position and a maintenance cover is removed.

The image reading apparatus 1 has, as depicted in FIGS. 2, 4 and 5, a supplying section 21, a pair of sheet width guide 22, a supplying roller 23, a separation roller 24, a separation piece 25, a common path formation section 26, three first LF rollers 27 (i.e., two first LF rollers 27A and one first LF roller 27B), three driven rollers 28 (i.e., two driven rollers 28A and one driven roller 28), a lower reader unit 29, the upper reader unit 30, three second LF rollers 31, three driven rollers 32, a driven roller 33, a first path formation unit 35, three driven rollers 36, an outlet 37 and a second path formation section 38.

The supplying section 21 is provided at substantially the central part, in the right-and-left direction, of the housing 2. A sheet S subject to image reading is placed on an upper surface 14 of the supplying section 21.

The pair of sheet width guides 22 is provided to the supplying section 21. The sheet width guides 22 are configured to face each other in the front-and-rear direction. The sheet width guides 22 are configured to move closer to each other and to separate from each other by the same amounts with respect to a center therebetween. A distance between the sheet width guides 22 is adjusted in accordance with a width of the sheet S, in the front-and-rear direction, which is placed on the upper surface 41 of the supplying section 21. The sheet S is to be inserted between the sheet width guides 22 from the right side, thereby the sheet S being placed on the upper surface 41 of the supplying section 21, with the center of the sheet S is aligned with the center of the pair of sheet width guides 22.

The supply roller 23 is arranged on the left side of the supplying section 21 and substantially at the central portion of the housing 2 in the front-and-rear direction. The supply roller 23 is provided to the housing 2 such that it is rotatable about an axis extending in the front-and-rear direction.

The separation roller 24 is arranged on the left side of the supplying roller 23 and substantially at the central portion in the front-and-rear direction of the housing 2. The separation roller 24 is provided to the housing 2 such that it is rotatable about an axis extending in the front-and-rear direction.

The separation piece 25 is arranged above the separation roller 24. The separation piece 25 is elastically biased to contact the circumferential surface of the separation roller 24 from the above.

The common path forming section 26 is provided to the housing 2 on the left side of the separation roller 24 and below the maintenance cover 4. The common path forming section 26 has an upper formation section 51 and a lower formation section 52. A lower surface 53 of the upper formation section 51 is inclined such that a left portion thereof is lower than a right portion. An upper surface 54 of the lower formation section 52 extends substantially parallelly with the lower surface 53 of the upper formation section 51 with a space therebetween. A space defined between the lower surface 53 of the upper formation section 51 and the upper surface 54 of the lower formation section 52 defines the common path 55 through which the sheet S is conveyed.

The first LF rollers 27 are provided on the downstream, in a conveying direction of the sheet S, of the separation roller 24 and the separation piece 25. A rotation shaft 56 is rotatably supported by the housing 2 with its rotation axis extending in the front-and-rear direction. Therefore, the rotation shaft 56 extends in the front-and-rear direction in a state where the rotation shaft 56 is supported by the housing 2. In a following description, directions concerning the rotation shaft 56, three first LF rollers 27, a spring shaft 57, three driven rollers 28, and the like are explained as directions when these elements are secured to or supported by the housing 2. The three first LF rollers 27 are secured to the rotation shaft 56, which extends in the front-and-rear direction, with evenly spaced from each other. The rotation shaft 56 is arranged such that it is on an upper side with respect to the lower surface 53 of the upper formation section 51 at substantially a central part of the upper formation section 51, in the right-and-left direction. A part of the circumferential surface of each of the first LF roller 27 protrudes through an opening (not shown) formed on the upper formation section 51 toward the common path 55.

Figure 6:
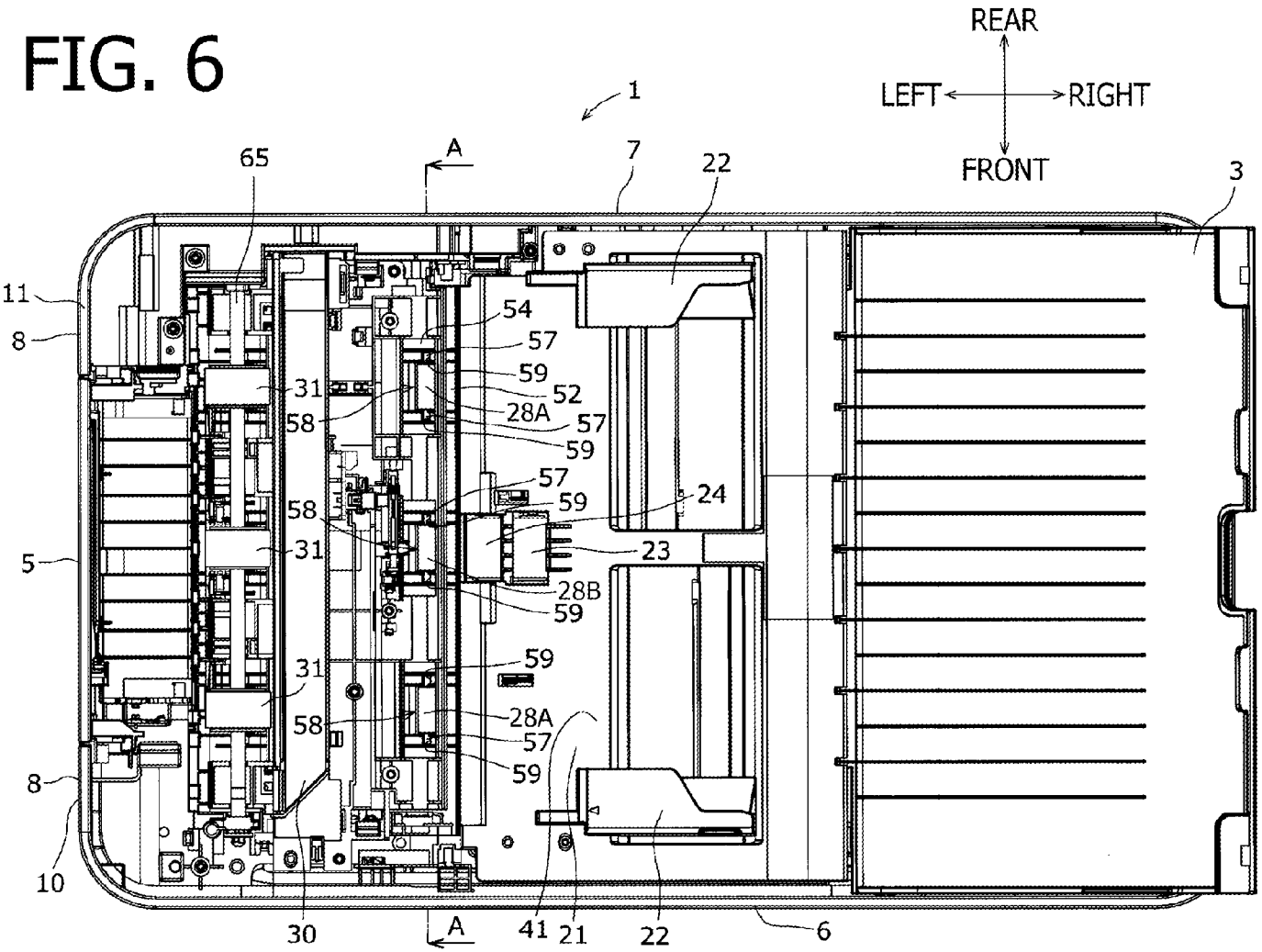
FIG. 6 is a perspective view of the image reading apparatus viewed from an upper-right front direction thereof, when the tray is located at the tray position and the maintenance cover and a first LF roller are removed.
Figure 7:
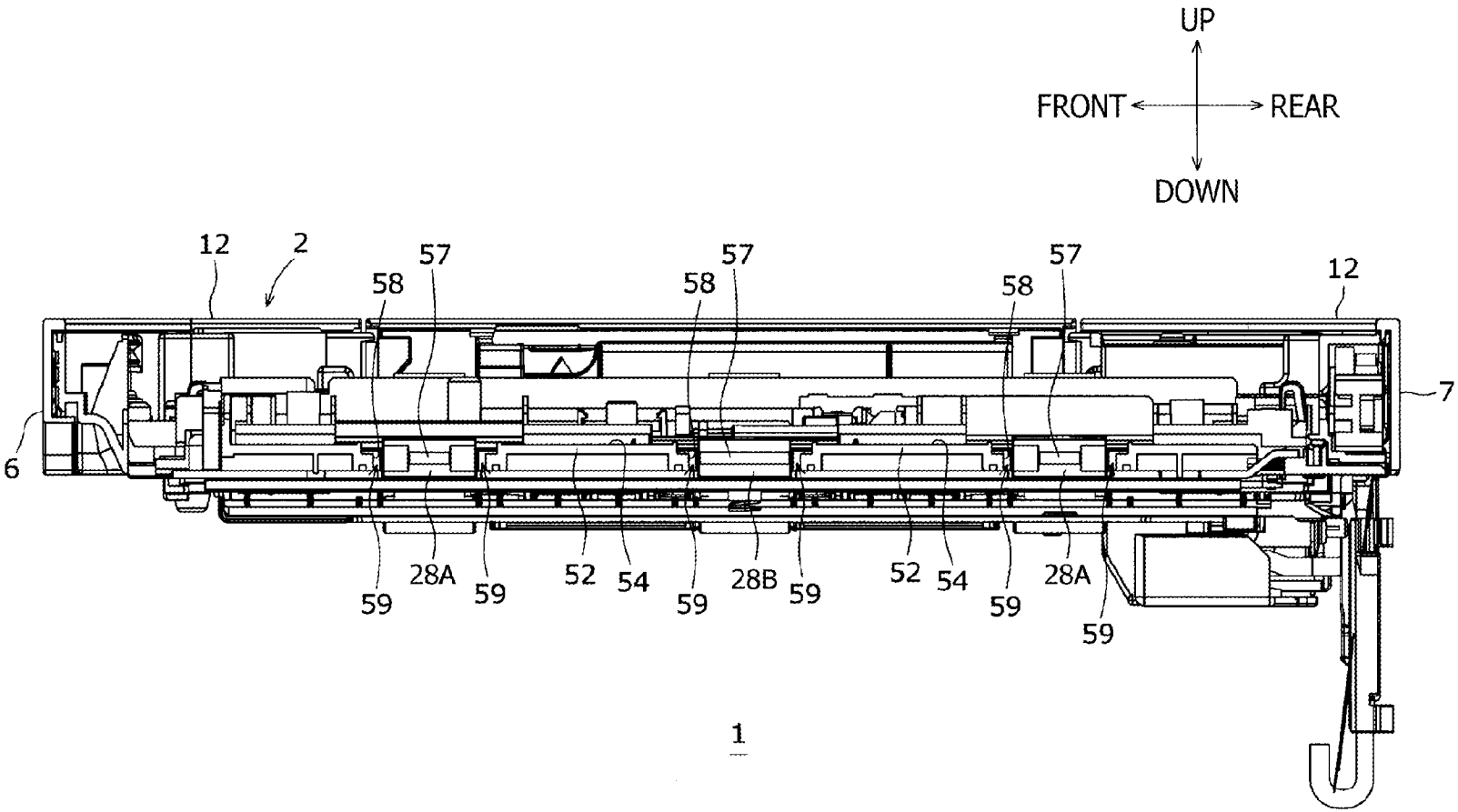
FIG. 7 is a cross-sectional view of the image reading apparatus taken along an A-A line indicated in FIG. 6.

The driven rollers 28A and 28B are, as depicted in FIGS. 6 and 7, arranged in the front-and-rear direction with evenly spaced from each other. Hereinafter, when the driven rollers are described without any specific indication of distinguishing one of the driven rollers from the others, the driven rollers will be indicated as the driven roller(s) 28, while the driven rollers should be distinguished from each other, the driven rollers are referred to as the driven roller 28A or 28B. Each driven roller 28 is supported by the spring shaft 57 extending in the front-and-rear direction. Each driven roller 28 is accommodated n a roller accommodation section 58. The roller accommodation section 58 is formed on the lower formation section 52. The roller accommodation section 58 is downwardly concave from the upper surface 54. Both end portions of the spring shaft 57 are supported by spring accommodation sections 59, respectively. The spring accommodation sections 59 are formed to be downwardly concave from the upper surface 54 of the lower formation section 52.

A part of the circumferential surface of each driven roller 28 protrudes upward from the roller accommodation section 58. The part of the driven roller 28 protruded from the roller accommodation section 58 contacts the circumferential surface of the first LF roller 27. That is, in the common path 55 defined by the upper formation section 51 and the lower formation section 52, a part of the circumferential surface of each driven roller 28 contacts the circumferential surface of the first LF roller 27. Each driven roller 28 is driven by the first LF roller 27. When the leading end of the sheet S is nipped between the circumferential surface of the first LF roller 27 and the circumferential surface of each of the driven rollers 28, a conveying force is applied to the sheet S as the first LF roller 27 is rotated.

Each driven roller 28 is configured to be rotationally symmetrical with respect to an axis of the spring shaft 57 extending in the front-and-rear direction. The driven rollers 28 have the same length in the front-and-rear direction.

Figure 8:
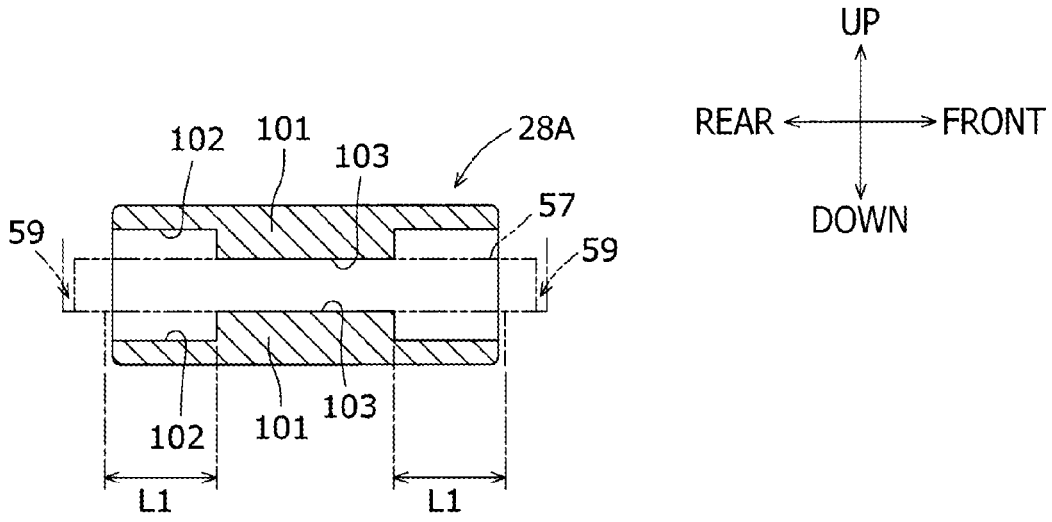
FIG. 8 is a cross-sectional view of one of driven rollers arranged at both sides in a front-and-rear direction.

Each of the driven rollers 28A which are arranged at both sides in the front-and-rear direction has a protrusion 101 as depicted in FIG. 8. The protrusion 101 is formed at a central portion, in the front-and-rear direction, of the driven roller 28A. The protrusion 101 protrudes from an inner surface 102 of the driven roller 28A toward the rotation axis of the driven roller 28A. A top surface 103 of the protrusion 101 is formed to have a cylindrical shape of which diameter is substantially the same as an outer diameter of the spring shaft 57. The spring shaft 57 is inserted in a space defined (i.e., surrounded) by the top surface 103. It is preferable that the spring shaft 57 is inserted in the space surround by the top surface 103 with contacting the same.

Figure 9:
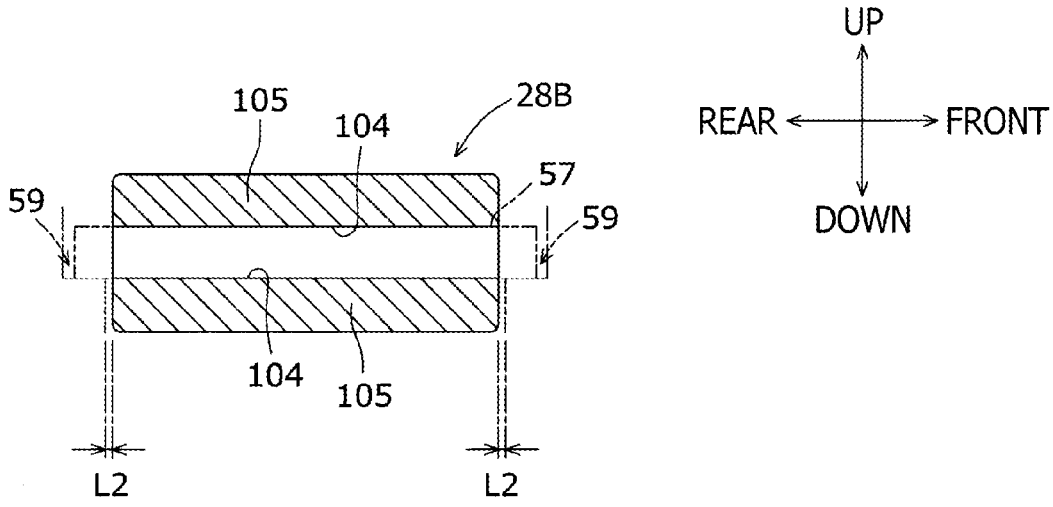
FIG. 9 is a cross-sectional view of a driven roller arranged at a central portion in a front-and-rear direction.

The driven roller 28B at the center of the three driven rollers 28 is configured to have an inner circumferential surface 104 as depicted in FIG. 9. A diameter of the inner circumferential surface 104 is substantially the same as a diameter of a space surrounded by the top surface 103 of the protrusion 101 formed to each of the driven rollers 28A at both side portions in the front-and-rear direction. In other words, the central driven roller 28B arranged at the central portion in the front-and-rear direction has a protrusion 105 which extends to bridge between one end surface, in the front-and-rear direction, and the other end surface. In the front-and-rear direction, the protrusion 105 is larger than the protrusion 101 of the driven roller 29A at each end portion in the front-and-rear direction. The inner circumferential surface 104 which is the top surface of the protrusion 105 is formed to have a cylindrical shape having substantially the same diameter as an outer diameter of the spring shaft 57. The spring shaft 57 is inserted in the space surrounded by the inner circumferential surface 104. It is preferable that the spring shaft 57 is inserted in the space surrounded by the inner circumferential surface 104 with contacting the inner circumferential surface 104.

According to the above configuration, a distance L1 between the front end (i.e., a front end in the front-and-rear direction) of the protrusion 101 and the rear end of the accommodating section 59 (i.e., a rear end of the front accommodation section 59), and a distance L1 between the rear end (i.e., a rear end in the front-and-rear direction) of the protrusion 101 and the front end of the accommodating section 59 (i.e., a front end of the rear accommodation section 59) are longer than a distance L2 which is a distance between the front end (i.e., a front end in the front-and-rear direction) of the protrusion 105 and the rear end of the accommodating section 59 (i.e., a rear end of the front accommodation section 59), or a distance L2 between the rear end (i.e., a rear end in the front-and-rear direction) of the protrusion 105 and the front end of the accommodating section 59 (i.e., a front end of the rear accommodation section 59).

The spring shaft 57 is a kind of a coil spring which is formed by winding a metallic wire member. The spring shafts 57 inserted in the respective driven rollers 28 are made of the same metallic wires, and have the same outer diameter and the same length in the front-and-rear direction.

Each driven roller 28 is urged toward the first LF roller 27 due to elastic characteristic of the spring shafts 57. In the following description, when the first LF rollers are described without discrimination therebetween, the roller will be referred to as the first LF roller 27, while when discrimination is necessary, the rollers are referred to as the first LF roller 27A and the second LF roller 28B. Specifically, when the driven roller 28 is attached to the housing 2, the driven roller 28 is accommodated in the roller accommodating section 58.

Further, both end portions of the spring shaft 57 are accommodated in the spring accommodation section 59. With this configuration, the driven roller 28 is supported by the housing 2 via the spring shaft 57. Then, the first LF rollers 27 are attached to the housing 2. The three first LF rollers 27 contact the driven rollers 28 from above respectively. As the first LF rollers 27 urge the drive rollers 28, respectively, each driven roller 28 is displaced downward against the elastic force of the spring shaft 57. Under such a state, both ends of the rotational shaft 56 of the first LF roller 27 are rotatably secured to the housing 2. As a result, each driven roller 28 is pressed by the first LF roller 27 due to the elastic characteristic of the spring shaft 57.

Since all the spring shafts 57 have the same structure, the shorter the distances L1 and L2 are, the greater the elastic forces generated on the spring shafts 57 as reactive forces against the pressing force by the driven rollers 28 are. As described above, the distance L2 is shorter than the distance L1. Therefore, the elastic force generated on the spring shaft 57 inserted in the central driven roller 28B, arranged at the central portion in the front-and-rear direction, is greater than that of the driven rollers 28A arranged at both sides in the front-and-rear direction. Therefore, the conveying forces applied to the sheet S from the first LF roller 27B at the central portion in the front-and-rear direction and the driven roller 28B at the central portion in the front-and-rear direction are greater than the conveying forces applied to the sheet S by the first LF rollers 27A at the side portions in the front-and-rear direction and the driven rollers 28A at the side portions in the front-and-rear direction.

The lower reader unit 29 has a lower contact glass 61 and a contact image sensor module 62 as depicted in FIGS. 2 and 4.

The lower contact glass 61 is held by the housing 2 below the supplying section 21, the supply roller 23, the separation roller 24 and the driven rollers 28. The lower contact glass 61 is a flat plate having a rectangular shape and arranged substantially parallel with the upper surface 12 of the housing 2. Longer sides of the lower contact glass 61 extend in the right-and-left direction, and the shorter sides extend in the front-and-rear direction. A light-side end portion of the lower contact glass 61 is arranged on the left of the common path forming section 26. A common path 55 extends a portion between a lower surface 53 of upper part forming section 51 and an upper surface 54 of a lower part forming section 52 leftward, via a portion above the lower contact glass 61.

The contact image sensor (CIS) module 62 is arranged below the lower contact glass 61 such that the contact image sensor module 62 is movable in the right-and-left direction. Inside the CIS module 62, an LED (light emitting diode) light source, a lens and an image sensor are provided. The CIS module 62 is located at a position lower left below the lower contact glass 61 when the ADF reading is performed or when the image reading apparatus 1 is not used.

The upper reader unit 30 has an upper contact glass 63 and a CIS module 64.

The upper contact glass 63 is held by the housing 2 at a position above the lower contact glass 61 and on the left of the lower contact glass 61. The upper contact glass 63 is also a rectangular plate member and longer sides thereof extend in the front-and-rear direction. Shorter sides of the upper contact glass 63 are slightly inclined with respect to the right-and-left direction but extend substantially in the right-and-left direction.

The CIS module 64 is arranged above the upper contact glass 63. Inside the CIS module 64, an LED light source, a lens and an image sensor are provided.

The three second LF rollers 31 are arranged on the left of the upper reader unit 30. The three second LF rollers 31 are attached to a rotation shaft 65 extending in the front-and-rear direction with spaced evenly. The rotation shaft 65 is rotatably held by the housing 2.

Three drive rollers 32 are arranged below the second LF rollers 31. The three driven rollers 32 are attached to a rotation shaft 66 extending in the front-and-rear direction with spaced evenly. The rotation shaft 66 is rotatably held by the housing 2. A part of a circumferential surface of each drive roller 32 contacts a circumferential surface of the second LF roller 31. The drive rollers 32 are driven to rotate as the second LF rollers 31 rotate.

The driven rollers 33 are arranged below the central second LF roller 31, and on the left of the driven rollers 32. In the driven roller 33, a rotation shaft 67 extending in the front-and-rear direction is inserted. The rotation shaft 67 is held by the housing 2. A part of the drive roller 33 contacts the central second LF roller 31. The driven roller 33 rotates as driven by rotation of the second LF roller 31. The common path 55 extends from a position where the separation roller 24 contacts the separation piece to a position where the second LF rollers 31 contact the drive roller 33.

A first path forming section 35 has an upper forming section 71 and a lower forming section 72. The upper forming section 71 is formed on an inner surface of the maintenance cover 4. A lower surface of the left side section 73 of the upper forming section 71 is formed to curve along the circumferential surface of the second LF roller 31 from a position spaced from the left side of the second LF roller 31. A lower surface of the right side section 74 of the upper forming section 71 is substantially parallel with the upper surface 12 of the housing 2, and extends in the front-and-rear and right-and-left directions. The lower forming section 72 is spaced below the right side section 74 of the upper forming section 71 and extends in the front-and-rear and right-and-left directions. A space is defined between the second LF roller 31 and the upper forming section 71, and between the upper forming section 71 and the lower forming section 72, which space is a first path 75 through which the sheet S passes. That is, the second LF roller 31 and the upper forming section 71 define a part of the first path 75 while the upper forming section 71 and the lower forming section 72 define another part of the first path 75.

Three driven rollers 36 are arranged above the second LF roller 31. The three driven rollers 36 are attached to a rotation shaft extending in the front-and-rear direction with spaced evenly. The rotation shaft 76 is rotatably held by the maintenance cover 4. A part of the circumferential surface of each of the drive roller 36 contacts, in the first path 75, the circumferential surface of the second LF roller 31. The driven rollers 32 are driven to rotate in accordance with rotation of the second LF roller 31.

The outlet 37 is formed on the right of the lower forming section 72 and above and spaced from the supplying section 21. An upper surface 77 of the outlet 37 is formed to have a substantially planar surface extending in the front-and-rear and right-and-left directions.

The second path forming section 38 is formed on the housing 2 on the left of the driven roller 33. The second path forming section 38 extends leftward slightly from a position on the left of the driven roller 33, spaced therefrom, bent to upper left to a position on the right and spaced for the right side of the lower side section of the outlet cover 5. A space above the second path forming section 38 is a second path 78 through which the sheet S passes.

The image reading apparatus 1 has a flapper 81 and a link mechanism 82.

The flapper 81 is arranged below the left side part of the upper forming section 71 of the first path forming section 35. The flapper 81 is supported by the housing 2 such that the flapper 81 movable to be oriented between an orientation depicted in FIG. 2 and an orientation depicted in FIG. 4. When oriented as depicted in FIG. 2, the flapper 81 allows the sheet S to enter the first path 75, while when oriented as depicted in FIG. 4, the flapper 81 extends along the second path 78. That is, when oriented as depicted in FIG. 4, the flapper 81 allows the sheet S to enter the second path 78.

The link mechanism 82 causes the flapper 81 to be displaced to have the orientation depicted in FIG. 2 and the orientation depicted in FIG. 4 in association with displacement of the outlet cover 5. Specifically, when the outlet cover 5 is displaced from the cover position to the tray position, the link mechanism 82 causes the flapper 81 having the orientation depicted in FIG. 2 to have the orientation depicted in FIG. 4. When the outlet over 5 is displaced from the tray position to the cover position, the link mechanism causes the flapper 81 having the orientation depicted in FIG. 4 to have the orientation depicted in FIG. 2.

The image reading apparatus has a first receiving member 91 and a second receiving member 93.

The first receiving member 91 is provided to the outlet cover 5 with spaced from an inner surface 94 of the outlet cover 5. With this configuration, between the first receiving member 91 and the inner surface 94 of the outlet cover 5, a space 95 capable of accommodating the second receiving member 93 is formed.

The second receiving member 93 is provided to be rotatable between an accommodation position at which the second receiving member 93 is accommodated in the space 95 and an extended position at which the second receiving member 93 is extended out of the space 95. The second receiving member 93 extends along the inner surface 94 of the outlet cover 5 from the space 95 when located at the extended position. The second receiving member 93 has an extending section 97 and the protruded section 98. The protruded section 8 is formed on the left of the extended section 97 when the second receiving member 93 is located at the extended position.

<Image Reading Operation 1>

When the sheet S subject to image reading is a sheet of which rigidity is relatively small, the outlet cover 5 is closed as depicted in FIGS. 1 and 2. That is, as the outlet path (i.e., an ejection path) of the sheet S, the first path 75 is selected. It is noted that opening/closing of the outlet cover 5 is done by a user manually. As described above, the sheet S is placed on the supplying section 21 and on the tray 3 with the centers thereof being aligned to each other.

In such a state, the leading end portion of the sheet S is arranged on the circumferential surface of the supplying roller 23. When an image reading operation is started in accordance with a user's instruction, the supplying roller 23 rotates counterclockwise in FIG. 2. Then, with a friction between the lowermost sheet S on the supplying section 21 and the circumferential surface of the supplying roller 23, the sheet S is fed between the separation roller 24 and the separation piece 25.

At this stage the separation roller 24 also rates counterclockwise in FIG. 2. As the leading end of the sheet S is nipped between the separation roller 24 and the separation piece 25, sheets S are separated one by one, each passing through the nip between the separation roller 24 and the separation piece 25 and sent to the common path 55.

At this stage, the first LF roller 27 is rotating clockwise in FIG. 2. Therefore, the driven roller 28 is being rotated counterclockwise in FIG. 2 in association with the rotation of the first LF roller 27. When the leading end of the sheet S fed into the common path 55 reaches a position where the circumferential surfaces of the first LF roller 27 and the driven roller 28 contact, the leading end of the sheet S is introduced in the nip between the circumferential surfaces of the first LF roller 27 and the driven roller 28. Then, a conveying force is applied from the first LF roller 27 and the driven roller 28 to the sheet S. When a length of the width of the sheet S in the front-and-rear direction is equal to or greater than a distance between the side drive rollers 28A, the driving force is applied to the sheet S from the three pairs of the first LF roller 27 and the driven roller 28. That is, the driving force is applied to the sheet S from a pair of the first LF roller 27B and the driven roller 28B arranged at the central portion in the front-and-rear direction. The driving force is also applied to the sheet S from the first LF rollers 27A and the drive rollers 28A which are arranged at both side portions in the front-and-rear direction.

Thereafter, the sheet S passes above the upper surface of the lower contact glass 61 and below the lower surface of the upper contact glass 63 in this order. To the sheet S above the upper surface of the lower contact glass 61, and to the sheet S below the lower surface of the upper contact glass 33, light is emitted from the LED light sources of the CIS modules 62 and 64, respectively. The light reflected by the sheet S is received by the image sensors of the CIS modules 62 and 64, respectively. As a result, images on both sides of the sheet S can be read.

At this stage, the second LF roller 31 is rotating clockwise in FIG. 2. Therefore, the driven rollers 32 and 33 are rotating counterclockwise in FIG. 2. When the leading end of the sheet S reaches a position where the circumferential surfaces of the second LF roller 31 and the driven roller 32 contact, conveying forces are applied from the second LF roller 31 and the driven roller 32 to the sheet S. Thereafter, when the leading end of the sheet reaches a position when the circumferential surfaces of the second LF roller 31 and the drive roller 33 contact, conveying forces are applied to the sheet S from the second LF roller 31 and the driven roller 33.

In this case, since the outlet cover 5 is closed, the flapper 81 has the orientation depicted in FIG. 2. That is, the flapper 81 closes a pathway to the second path 78 and opens a pathway to the first path 75. It is noted that an expression "to close a pathway to the second path 78" does not always mean that the pathway to the second path 78 is completely closed, but include a situation that the pathway is partially closed and only suppresses entrance of the sheet S to the second path 78. Similarly, an expression "to open the pathway to the first path 75" is not used to always mean that the pathway is completely opened. Therefore, the sheet S fed out from the nip between the second LF roller 31 and the driven roller 32 proceeds such that the leading end moves along the inner surface of the flapper 81, thereby the sheet S being conveyed along the first path 75.

The driven roller 36 rotates counterclockwise in FIG. 2 in accordance with the rotation of the second LF roller 31. When the leading end of the sheet S reaches a position where the circumferential surfaces of the second LF roller 31 and the driven roller 36, conveying forces are applied to the sheet S from the second LF roller 31 and the driven roller 36.

The sheet S passed through the nip between the second LF roller 31 and the driven roller 36 is discharged, for example, as bridging between the outlet section 37 and the tray 3. The leading end of the sheet S is, for example, passes the right end part of the outlet section 37 and placed on the tray 3. The trailing end of the sheet S remains, for example, in the outlet section 37 and placed on the outlet section 37. With this configuration, it is prevented that the sheet S on the outlet section 37 and the sheet S bridging on the supplying section 21 and the tray 3 are overlaid.

<Image Reading Operation 2>

When the sheet S subject to image reading is a relatively rigid sheet such as a postcard or name card, the outlet cover 5 is opened as depicted in FIG. 3 or FIG. 4. That is, as an outlet path of the sheet S, the second path 78 is selected. As mentioned above, opening/closing of the outlet cover 5 is done by a user manually. The sheet S is inserted between a pair of sheet width guides 22 from the right side, and arranged on the upper surface 41 of the supplying section with the centers thereof being aligned to each other.

At this stage, the leading end of the sheet S is arranged on the circumferential surface of the supplying roller 23. When the image reading operation is started in accordance with the user instruction, the supplying roller 23 rotates counterclockwise in FIG. 2. Then, by the frictional force between the lowermost sheet S and the circumferential surface of the supplying roller 23, the sheet S is introduced in a position where the separation roller 24 contacts the separation piece 25.

At this stage, the separation roller 24 is rotating counterclockwise in FIG. 2. When the leading end of the sheet S is nipped between the separation roller 24 and the separation piece 25, a plurality of sheets S is separated one by one, and only one sheet S passes through a position between the separation roller 24 and the separation piece 25, and the sheet S is sent to the common path 55.

At this stage, the first LF rollers 27 are rotating clockwise in FIG. 2. Therefore, the driven rollers 28 rotate counterclockwise in association with the rotation of the first LF rollers 27. When the leading end of the sheet S reaches the position where the circumferential surfaces of the first LF rollers 27 and the driven rollers 28 contact, the leading end of the sheet S is introduced in the nip between the first LF rollers 27 and the driven rollers 28. Thus, the conveying forces are applied to the sheet S from the first LF rollers 27 and the driven rollers 28. When the length of the width of the sheet S along the front-and-rear direction is longer than a distance between the driven rollers 28A at both side portions in the front-and-rear direction, the conveying forces are applied to the sheet S from three pairs of the first LF roller 27 and the driven roller 28. That is, the conveying force is applied by a pair of the first LF roller 27B and the driven roller 28B arranged at the central portion in the front-and-rear direction, and further the conveying forces are applied to the sheet S by two pairs of the first LF roller 27A and the driven roller 28A arranged at both side portions in the front-and-rear direction. If the length of the width of the sheet S in the front-and-rear direction is less than the distance between the two driven rollers 28A arranged at both end portions in the front-and-rear direction, the conveying force is applied to the sheet S only by one pair of the first roller 27B and the driven roller 28B arranged at the central portion in the front-and-rear direction.

When the leading end of the sheet S is located between the circumferential surfaces of the first LF roller 27B and the driven roller 28B, the trailing end portion of the sheet S, that is the upstream side end portion, in the sheet conveying direction, of the sheet S is located between the separation roller 24 and the separation piece 25. Therefore, to the sheet S, the conveying force directed to downstream side in the conveying direction is applied by the first LF roller 27B and the driven roller 28B, while a frictional force directed to the upstream side in the conveying direction is applied by the separation roller 24 and the separation piece 25 as a back tension.

Thereafter, the sheet S passes above the upper surface of the lower contact glass 61 and below the lower surface of the upper contact glass 63 in this order. To the sheet S above the upper surface of the lower contact glass 61, and to the sheet S below the lower surface of the upper contact glass 33, light is emitted from the LED light sources of the CIS modules 62 and 64, respectively. The light reflected by the sheet S is received by the image sensors of the CIS modules 62 and 64, respectively. As a result, images on both sides of the sheet S can be read.

At this stage, the second LF roller 31 is rotating clockwise in FIG. 2. Therefore, the driven rollers 32 and 33 are rotating counterclockwise in FIG. 2. When the leading end of the sheet S reaches a position where the circumferential surfaces of the second LF roller 31 and the driven roller 32 contact, conveying forces are applied from the second LF roller 31 and the driven roller 32 to the sheet S. Thereafter, when the leading end of the sheet reaches a position when the circumferential surfaces of the second LF roller 31 and the drive roller 33 contact, conveying forces are applied to the sheet S from the second LF roller 31 and the driven roller 33.

In this case, since the outlet cover 5 is opened, the flapper 81 has the orientation depicted in FIG. 4. That is, the flapper 81 opens a pathway to the second path 78, while closes a pathway to the first path 75. It is noted that an expression "to close a pathway to the first path 75" does not always mean that the pathway to the first path 75 is completely closed, but include a situation that the pathway is partially closed and only suppresses entrance of the sheet S to the first path 75. Similarly, an expression "to open the pathway to the second path 78" is not used to always mean that the pathway is completely opened. Therefore, the sheet S fed out from the nip between the second LF roller 31 and the driven roller 32 proceeds such that the leading end is conveyed below the flapper 81.

The sheet S passed below the flapper 81 is conveyed along the second path 78. When the sheet S passes through the nip between the second LF roller 31 and the driven roller 32, discharge of the sheet S from the housing 2 is completed. The sheet S discharged from the housing 2 is received by a first receiving member and a second receiving member 93, and held thereby.

As described above, to the sheet S of which the length of the width in the front-and-rear direction is equal to or greater than a distance between the driven rollers 28A arranged at both end portions in the front-and-rear direction, the conveying forces are applied to the sheet S by the three pairs of the first LF roller 27 and the driven roller 28. That is, for the normal sheet S, the conveying force is applied by the pair of the first LF roller 27B and the driven roller 28B which is arranged at the central portion in the front-and-rear direction. Further, to such a sheet S, the conveying forces are also applied by two additional pairs of the first LF roller 27A and the driven roller 28A, which are arranged at both end portions in the front-and-rear direction.

To the sheet S of which the length of the width in the front-and-rear direction is less than the distance between the two driven rollers 28A arrange at both side portions in the front-and-rear direction, that is, to a small size sheet S, the conveying force is applied only by the first roller 27B and the driven roller 28B which are arranged at the central portion in the front-and-rear direction.

The image reading apparatus 1 according to the embodiment is configured such that the conveying forces applied by the driven roller 28B and the first LF roller 27B, which are arranged at the central portion in the front-and-rear direction are stronger than those applied by each pair of the driven roller 28A and the first LF roller 27A arranged at a side portions in the front-and-rear direction. In other words, the conveying force of a pair of the driven roller 28B and the first LF roller 27B is stronger than the conveying force of each pair of the driven roller 28A and the first LF roller 27A. With this configuration, when a small size sheet S is conveyed, shortage of the conveying force applied to the sheet S can be suppressed. As a result, the small size sheet can be conveyed at appropriate conveying speed. Since the sheet S can be appropriately even if the size is small, expansion of the image read by the lower reader unit 29 and the upper reader unit 30 in the right-and-left direction due to insufficient conveying force for a small sheet S can be suppressed.

The image reading apparatus 1 according to the embodiment is configured such that the spring shaft 57 is inserted in each driven roller 28 in the front-and-rear direction, as described above.

According to such a configuration, it becomes possible to make the driven roller 28 press-contact the first LF roller 27 by the elastic force of the spring shaft 57. Further, in comparison with a configuration in which a shaft of the driven roller 28 is urged using a coil spring or the like, a size of the image reading apparatus 1 in a up-and-down direction can be suppressed since the number of components can be reduced and/or a space for the mechanical structure can be reduced.

Further, as described above, the driven roller 28B arranged at the central portion in the front-and-rear direction has the protrusion 105, while each of the driven rollers 28A arranged at side portions in the front-and-rear direction has the protrusion 101. The length of the protrusion 105 in the front-and-rear direction is greater than the length of the protrusion 101 in the front-and-rear direction.

According to the above configuration, a distance L1 between the front end (i.e., a front end in the front-and-rear direction) of the protrusion 101 of the driven roller 28A arranged at each side portion in the front-and-rear direction and the rear end of the accommodating section 59 (i.e., a rear end of the front accommodation section 59), and a distance L1 between the rear end (i.e., a rear end in the front-and-rear direction) of the protrusion 101 and the front end of the accommodating section 59 (i.e., a front end of the rear accommodation section 59) are longer than a distance L2 between the front end (i.e., a front end in the front-and-rear direction) of the protrusion 105 of the driven roller 28B arranged at the central portion in the front-and-rear direction and the rear end of the accommodating section 59 (i.e., a rear end of the front accommodation section 59), or a distance L2 between the rear end (i.e., a rear end in the front-and-rear direction) of the protrusion 105 and the front end of the accommodating section 59 (i.e., a front end of the rear accommodation section 59). Since all the spring shafts 57 have the same structure, the shorter the distances L1 and L2 are, the greater the elastic forces generated on the spring shafts 57 as reactive forces against the pressing force by the driven rollers 28 are. Therefore, it is possible to make the conveying force of the sheet S by a pair of the driven roller 28B and the first LF roller 27B greater than the conveying force by each pair of the driven roller 28A and the first LF roller 27A.

<Modified Embodiments>

Figure 10:
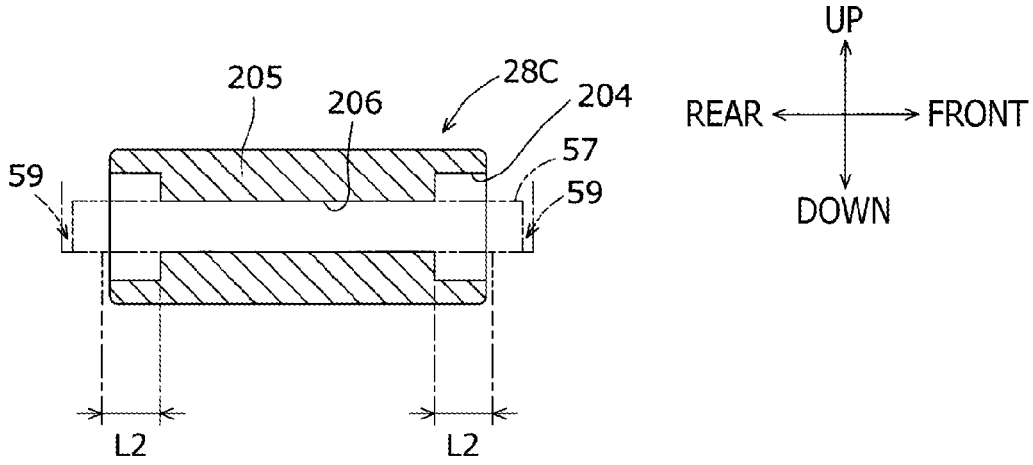
FIG. 10 is a cross-sectional view of a driven roller arranged at a central portion in a front-and-rear direction.

A configuration of the driven roller 28B arranged at the central portion in the front-and-rear direction is not limited to the configuration depicted in FIG. 9. For example, a configuration depicted in FIG. 10 may be employed as the configuration of the driven roller 28B arranged at the central portion in the front-and-rear direction. In the configuration depicted in FIG. 10, a driven roller 28C arranged at the central portion in the front-and-rear direction has a protrusion 205. The protrusion 205 is configured to protrude from an inner circumferential surface 204 of the driven roller 28C toward the spring shaft 57. An end surface 206 of the protrusion 205 is larger than the end surface 103 of the protrusion 101 of the driven roller 28B. According to the above configuration, a distance L2 between the front end (i.e., a front end in the front-and-rear direction) of the protrusion 205 of the driven roller 28C arranged at each side portion in the front-and-rear direction and the rear end of the accommodating section 59 (i.e., a rear end of the front accommodation section 59), and a distance L2 between the rear end (i.e., a rear end in the front-and-rear direction) of the protrusion 205 and the front end of the accommodating section 59 (i.e., a front end of the rear accommodation section 59) are shorter than a distance L1 between the front end (i.e., a front end in the front-and-rear direction) of the protrusion 101 of the driven roller 28B arranged at the central portion in the front-and-rear direction and the rear end of the accommodating section 59 (i.e., a rear end of the front accommodation section 59), or a distance L1 between the rear end (i.e., a rear end in the front-and-rear direction) of the protrusion 101 and the front end of the accommodating section 59 (i.e., a front end of the rear accommodation section 59) depicted in FIG. 8. Therefore, even if the driven roller 28C depicted in FIG. 10 is employed with the driven roller arranged at the central portion in the front-and-rear direction, it is possible to make the conveying force of the sheet S by a pair of the driven roller 28C and the first LF roller 27Bgreater than the conveying force by each pair of the driven roller 28A and the first LF roller 27A.

Figure 11:
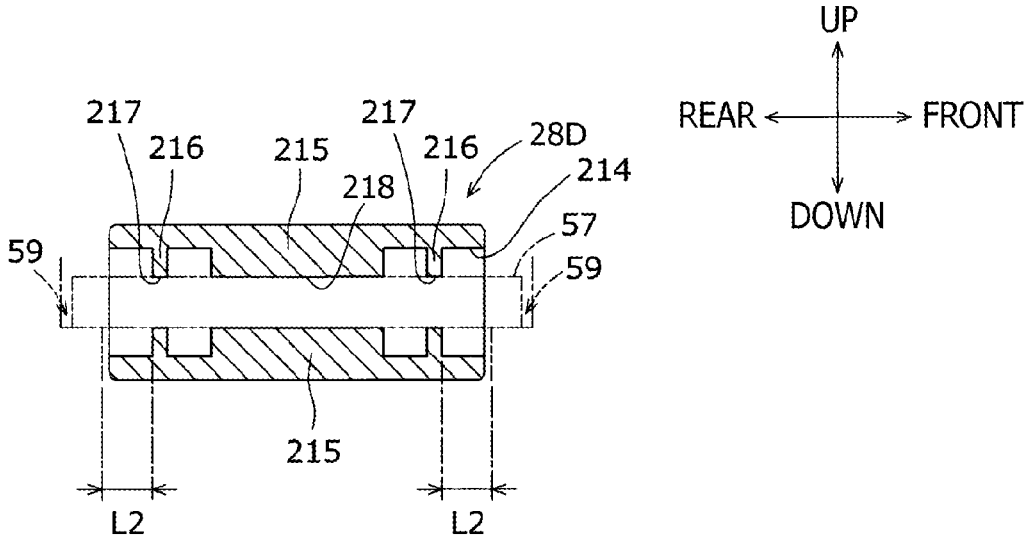
FIG. 11 is a cross-sectional view of a driven roller arranged at a central portion in a front-and-rear direction.

Alternatively, a configuration depicted in FIG. 11 may be employed as a configuration of the driven roller arranged at the central portion in the front-and-rear direction. According to the configuration depicted in FIG. 11, a driven roller 28D arranged at the central portion in the front-and-rear direction has a protrusion 215 and two protrusions 216. The protrusion 215 and the two protrusions 216 are formed to protrude from the inner circumferential surface 214 toward the spring shaft 57. The protrusion 215 is formed at a central portion, in the front-and-rear direction, of the driven roller 28D. The protrusion 215 is the same size as the protrusion 103 of the driven roller 28 depicted in FIG. 8. The protrusions 216 are formed spaced from the protrusion 215 in the front-and-rear direction. The top surface 218 of the protrusion 215 and the top surface 217 of the protrusion 216 are formed to define a cylindrical surface which has substantially the same diameter as the outer diameter of the shaft spring 57. The spring shaft 57 is inserted in a space surrounded by the top surfaces 217 and 218. In this case, it is preferable that the spring shaft 57 is inserted in the space surrounded by the top surfaces 217 and 218 contacting the same.

According to the above configuration, a distance L2 between the front end (i.e., a front end in the front-and-rear direction) of the protrusion 216 of the driven roller 28D arranged at each side portion in the front-and-rear direction and the rear end of the accommodating section 59 (i.e., a rear end of the front accommodation section 59), and a distance L2 between the rear end (i.e., a rear end in the front-and-rear direction) of the protrusion 216 and the front end of the accommodating section 59 (i.e., a front end of the rear accommodation section 59) are shorter than a distance L1 which is a distance between the front end (i.e., a front end in the front-and-rear direction) of the protrusion 101 of the driven roller 28B arranged at the central portion in the front-and-rear direction and the rear end of the accommodating section 59 (i.e., a rear end of the front accommodation section 59), or a distance L1 between the rear end (i.e., a rear end in the front-and-rear direction) of the protrusion 101 and the front end of the accommodating section 59 (i.e., a front end of the rear accommodation section 59) depicted in FIG. 8. Therefore, even if the driven roller 28D depicted in FIG. 11 is employed with the central portion in the front-and-rear direction, it is possible to make the conveying force of the sheet S by a pair of the driven roller 28D and the first LF roller 27B greater than the conveying force by each pair of the driven roller 28A and the first LF roller 27A.

The configurations of the three driven rollers 28 may be identical to each other. In such a case, in order to make the conveying force applied by a pair of the driven roller 28 and the first LF roller 27 arranged at the central portion in the front-and-rear direction greater than the conveying force of a pair of the driven roller 28 and the first LF roller 27 arranged at each side portion in the front-and-rear direction, a spring constant of the shaft spring 57 inserted in the driven roller 28 arranged at the central portion in the front-and-rear direction may be set to greater than the spring constant of the shaft spring 57 inserted in the driven roller 28 arranged at each side portion in the front-and-rear direction.

In order to make the conveying force applied by a pair of the driven roller 28 and the first LF roller 27 arranged at the central portion in the front-and-rear direction greater than the conveying force of a pair of the driven roller 28 and the first LF roller 27 arranged at each side portion in the front-and-rear direction, a length of the spring shaft 57 inserted in the driven roller 28 arranged at the central portion in the front-and-rear direction may be shorter than that of the spring shaft 57 inserted in the driven roller 28 arranged at each side portion in the front-and-rear direction. In this case, the configurations of the three driven rollers 28 are identical except for the length in the front-and-rear direction. The length of the driven roller 28 arranged at the central portion in the front-and-rear direction may be made shorter in accordance with the length of the spring shaft 57 to be inserted in the driven roller 28 arranged at the central portion in the front-and-rear direction.

In order to make the conveying force applied by a pair of the driven roller 28 and the first LF roller 27 arranged at the central portion in the front-and-rear direction greater than the conveying force of a pair of the driven roller 28 and the first LF roller 27 arranged at each side portion in the front-and-rear direction, a displaceable amount of the spring shaft 57 inserted in the driven roller 28 arranged at the central portion in the front-and-rear direction may be set to be larger than the displaceable amount of the spring shaft 57 inserted in the driven roller arranged at each side in the front-and-rear direction.

In the above described embodiment and modifications, the spring shaft 57 is inserted in the driven roller 28. Alternatively, a metal shaft which is a rigid body may be inserted in the driven roller which has the same structure as the driven roller 28. In this case, in order to make the driven roller 28 press-contacts the first LF roller 27, an urging member that urges the rotation shaft (i.e., the metal shaft) toward the rotation shaft 56 of the first LF roller 27 may be employed. In this case, the urging force applied by the urging member to urge the metal shaft inserted in the driven roller 28 toward the rotation shaft 56 of the first LF roller 27 may be set to greater than the urging force to urge the metal shaft of the driven roller 28 arranged at each end. For this purpose, the urging force of the urging member (e.g., the spring constant) may be adjusted. Alternatively or optionally, the length from the urging member to the metal shaft may be adjusted to set an appropriate urging force.

In order to make the conveying force applied by a pair of the driven roller 28 and the first LF roller 27 arranged at the central portion in the front-and-rear direction greater than the conveying force of a pair of the driven roller 28 and the first LF roller 27 arranged at each side portion in the front-and-rear direction, friction factors of the driven rollers 28 may be differentiated such that the friction factors of the driven roller 28 or the first LF roller 27 contacting the driven roller 28 which are arranged at the central portion in the front-and-rear direction may be made greater than that of the driven roller 28 or the first LF roller 27 arranged at the side portion in the front-and-rear direction. In this case, the friction factor of material or the roller or the friction factor of the material arranged on the surface of the rollers may be adjusted.

Further, in order to make the conveying force applied by a pair of the driven roller 28 and the first LF roller 27 arranged at the central portion in the front-and-rear direction greater than the conveying force of a pair of the driven roller 28 and the first LF roller 27 arranged at each side portion in the front-and-rear direction, the outer diameter of the driven roller 28 arranged at the central portion in the front-and-rear direction may be made larger than the outer diameter of each of the driven rollers 28 arranged at the side portions in the front-and-rear directions.

More than three driven rollers 28 may be arranged in the front-and-rear direction. In such a case, in comparison with the conveying force of the driven rollers 28 and the first LF roller 27 at the side portions in the front-and-rear direction, the conveying force of the other driven rollers 28 and the first LF rollers 27 may be set stronger.

Alternatively or optionally, various modifications can be realized without departing from the scope of the invention.

What is claimed:

1. An image reading apparatus, comprising:

a separation roller configured to supply a sheet one by one;

at least three driving rollers arranged downstream of the separation roller in a sheet conveying direction and configured to convey the sheet;

at least three driven rollers configured to be urged by the driving rollers and driven to rotate by rotation of the driving rollers, respectively;

a spring shaft which is inserted in each of the at least three driven rollers in a sheet width direction; and an image reader unit configured to read an image of the sheet conveyed in the sheet conveying direction, wherein the at least three driven rollers are arranged at a central portion and both side portions in the sheet width direction, wherein sheet conveying forces by one of the at least three driven rollers and one of the at least three driving rollers arranged at the central portions in the sheet width direction are greater than sheet conveying forces by others of the at least three driven rollers and others of the at least three driving rollers arranged at both side portions in the sheet width direction, wherein each of the at least three driven rollers has a protrusion which is formed at a central part of the driven roller in the sheet width direction and protrudes toward the spring shaft, and wherein a width of the protrusion of one of the at least three driven rollers, which is arranged at the central portion in the sheet width direction, is greater than a width of the protrusions of others of the at least three driven rollers, which are arranged at the side portions in the sheet width direction.

2. The image reading apparatus according to claim 1, wherein each of the others of the at least three driven rollers have only one protrusion.

3. An image reading apparatus, comprising:

a separation roller configured to supply a sheet one by one;

at least three driving rollers arranged downstream of the separation roller in a sheet conveying direction and configured to convey the sheet;

at least three driven rollers configured to be urged by the driving rollers and driven to rotate by rotation of the driving rollers, respectively;

a spring shaft which is inserted in each of the at least three driven rollers in a sheet width direction; and an image reader unit configured to read an image of the sheet conveyed in the sheet conveying direction, wherein the at least three driven rollers are arranged at a central portion and both side portions in the sheet width direction, wherein sheet conveying forces by one of the at least three driven rollers and one of the at least three driving rollers arranged at the central portions in the sheet width direction are greater than sheet conveying forces by others of the at least three driven rollers and others of the at least three driving rollers arranged at both side portions in the sheet width direction, wherein each of the at least three driven rollers has a protrusion which is formed at a central part of the driven roller in the sheet width direction and protrudes toward the spring shaft, and wherein one of the following conditions exists a spring constant of a portion of the spring shaft disposed at one of the at least three driven rollers, which is arranged at the central portion in the sheet width direction, is greater than a spring constant of portions of the spring shaft disposed at others of the at least three driven rollers, which are arranged at the side portions in the sheet width direction, or a displaceable amount of the spring shaft inserted in one of the at least three driven rollers, which is arranged at the central portion in the sheet width direction, is greater than a displaceable amount of the spring shaft inserted in others of the at least three driven rollers, which are arranged at the side portions in the sheet width direction.

4. An image reading apparatus, comprising:

a separation roller configured to supply a sheet one by one;

at least three driving rollers arranged downstream of the separation roller in a sheet conveying direction and configured to convey the sheet;

at least three driven rollers configured to be urged by the driving rollers and driven to rotate by rotation of the driving rollers, respectively;

a spring shaft which is inserted in each of the at least three driven rollers in a sheet width direction; and an image reader unit configured to read an image of the sheet conveyed in the sheet conveying direction, wherein the at least three driven rollers are arranged at a central portion and both side portions in the sheet width direction, wherein sheet conveying forces by one of the at least three driven rollers and one of the at least three driving rollers arranged at the central portions in the sheet width direction are greater than sheet conveying forces by others of the at least three driven rollers and others of the at least three driving rollers arranged at both side portions in the sheet width direction, wherein each of the at least three driven rollers has a protrusion which is formed at a central part of the driven roller in the sheet width direction and protrudes toward the spring shaft, and wherein one of the following conditions exists:

1) a spring constant of a portion of the spring shaft disposed at one of the at least three driven rollers, which is arranged at the central portion in the sheet width direction, is greater than a spring constant of portions of the spring shaft disposed at others of the at least three driven rollers, which are arranged at the side portions in the sheet width direction, 2) a coefficient of friction of one of the at least three driven rollers, which is arranged at the central portion in the sheet width direction, is greater than a coefficient of friction of others of the at least three driven rollers, which are arranged at the side portions in the sheet width direction, or 3) an outer diameter of one of the at least three driven rollers, which is arranged at the central portion in the sheet width direction, is greater than an outer diameter of others of the at least three driven rollers, which are arranged at the side portions in the sheet width direction.

* * * * *